US005386656A

United States Patent [19]

Bergman

[11] Patent Number: 5,386,656

[45] Date of Patent: Feb. 7, 1995

[54] PLAY CARD

[76] Inventor: Stephen Bergman, 10675 Providence Dr., Villa Park, Calif. 92667

[21] Appl. No.: 185,139

[22] Filed: Jan. 24, 1994

[51] Int. Cl.[6] ..... G09F 1/00

[52] U.S. Cl. ..... 40/539; 40/124.1

[58] Field of Search ..... 40/124.1, 539; 446/148; 229/92.8

[56] References Cited

U.S. PATENT DOCUMENTS

| | | | |
|---|---|---|---|
| Re. 22,109 | 6/1942 | Hayes | 40/124.1 |
| 2,016,129 | 10/1935 | Williamson . | |
| 2,125,424 | 8/1938 | Cloud | 40/539 |
| 2,148,279 | 2/1939 | Sandberg . | |
| 2,203,578 | 6/1940 | Podmore . | |
| 2,415,501 | 2/1947 | Klein et al. . | |
| 2,511,211 | 6/1950 | Klein et al. . | |
| 2,742,723 | 4/1956 | Klein et al. | 40/124.1 X |
| 3,090,144 | 5/1963 | Malamude | 40/124.1 |
| 4,062,138 | 12/1977 | Warenback | 40/124.1 |
| 4,735,356 | 4/1988 | Engel | 229/92.8 X |
| 4,949,482 | 8/1990 | Price | 40/124.1 |
| 5,010,669 | 4/1991 | Moran | 40/539 |

*Primary Examiner*—Kenneth J. Dorner

*Assistant Examiner*—Joanne Silbermann

*Attorney, Agent, or Firm*—Connors & Associates; John J. Connors

[57] ABSTRACT

Disclosed is a play card 10 which has a folded configuration and an unfolded configuration displaying a raised, or pop-up, figure on a base for the card. The play card 10 comprises a generally rectangular, single, unitary sheet material 12 with a plurality of score lines 22, 24, 14, 34, 15, 60 that are perpendicular to the longitudinal axis x of the sheet material and are each respectively positioned inward from the leading and trailing edges of the sheet material at precise locations. The sheet material 12 is folded inward along certain score lines to provide a base section 16, a central section 18, a back section 20, including a front panel 26, a connector panel 30, and a top panel 28 having a portion of the figure die-cut in outline form into the top panel. The central section 18 is folded to bring the connector panel 30 into an abutting relationship with a portion of the central section 18, and attached thereto to provide a collapsible box-like base structure 50 with a gap 42 between the connector panel and this portion. The gap 42 receives and holds the leading edge 12*c* of the sheet material 12 when the play card 10 is in the unfolded configuration.

20 Claims, 3 Drawing Sheets

10
12
12a
12b
12e
13
13a
14
15
16
18
20
22
24
26
28
30
34
42
44
60
d
f
X

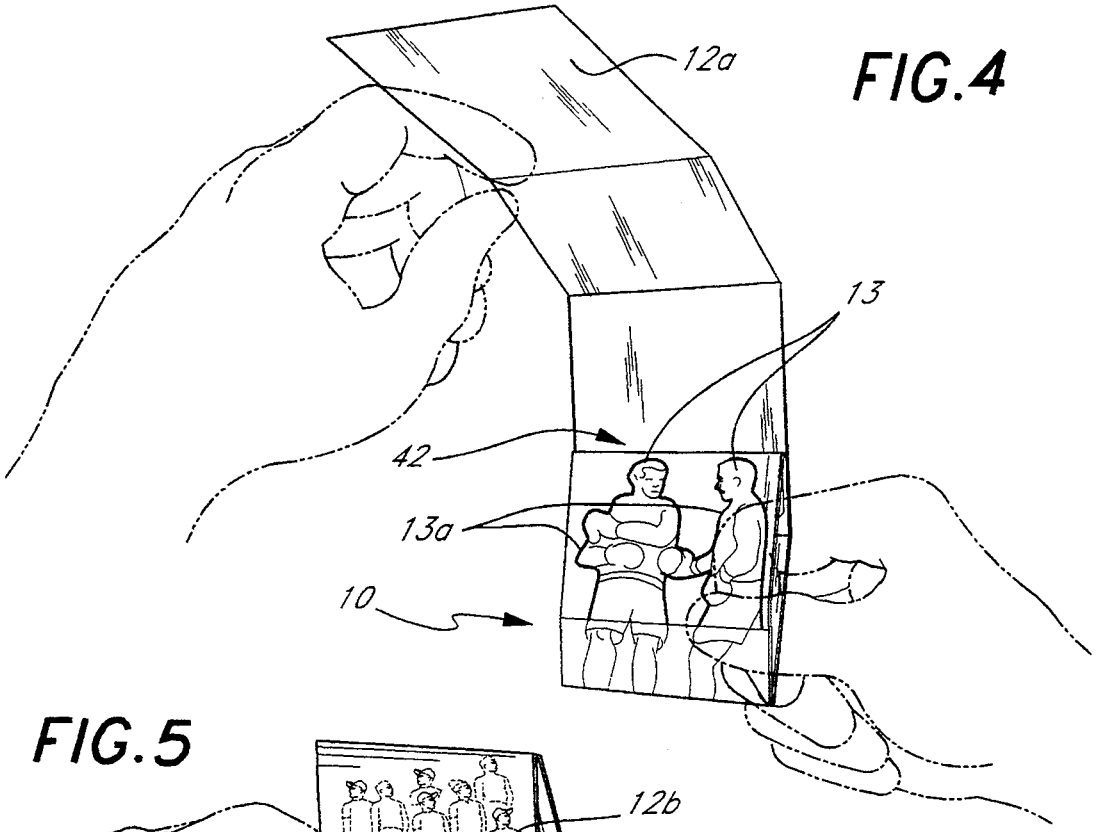
FIG. 4
FIG. 5
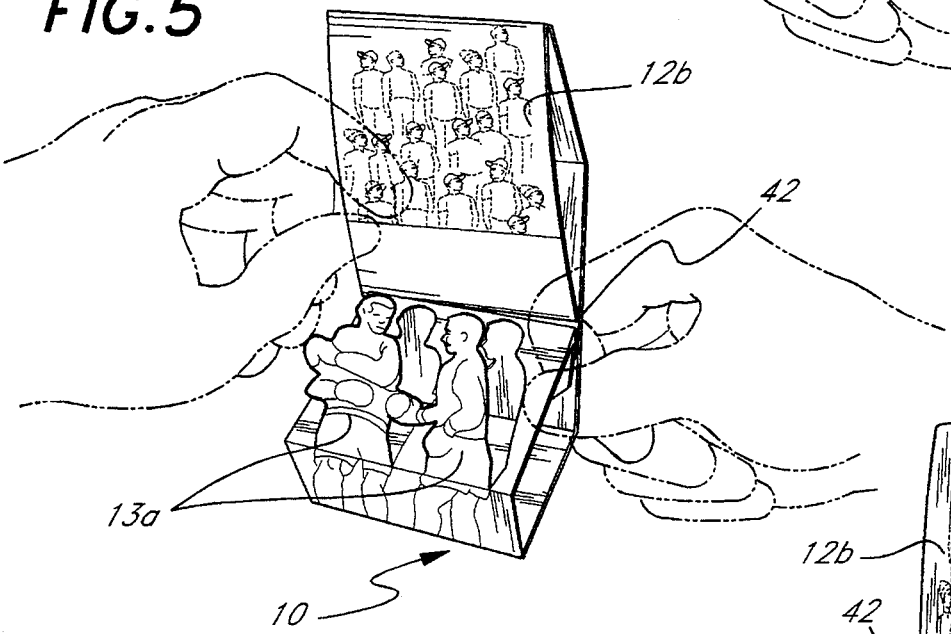
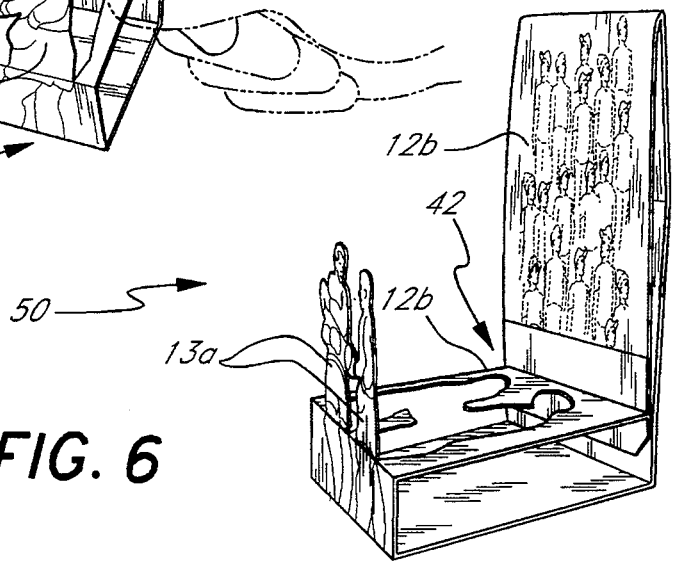
FIG. 6

FIG. 7
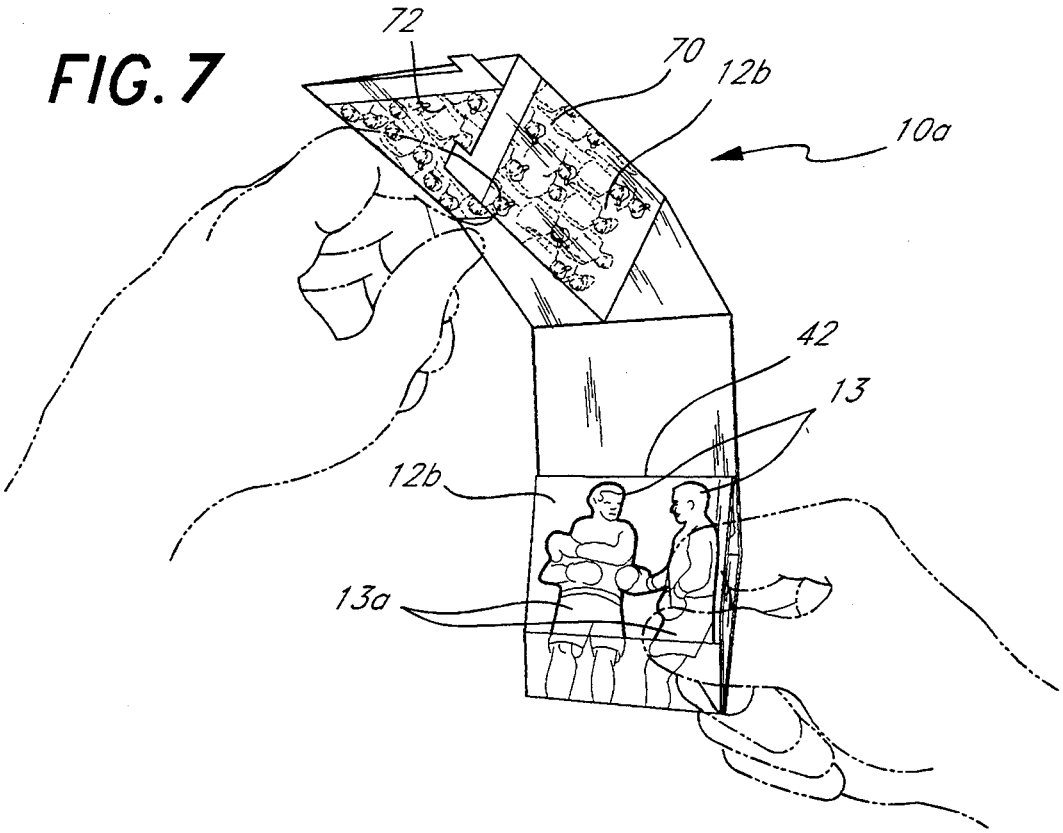
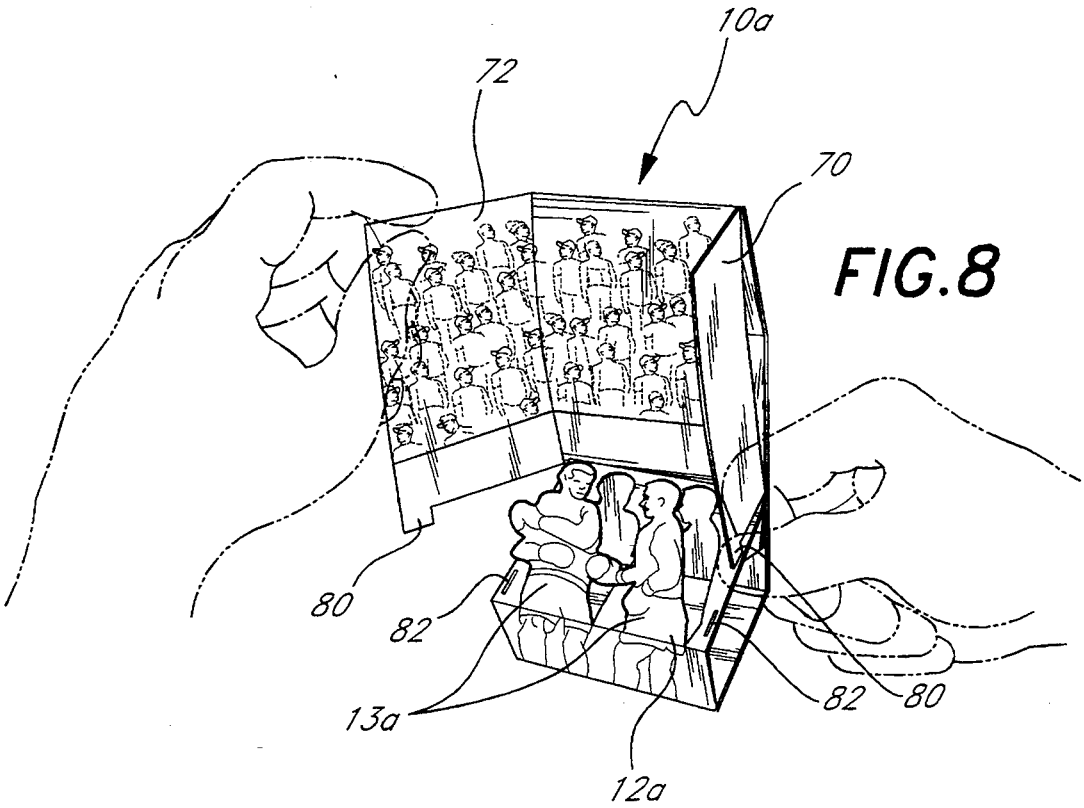
FIG. 8

PLAY CARD

BACKGROUND OF THE INVENTION 1. Field of the Invention

This invention relates to a play card which has a folded and unfolded configuration. In particular, a play card having a printed, pop-up picture of figure of, for example, a celebrity cut in outline form on a collapsible box-like base structure and a back section tucked into position adjacent the base structure.

2. Background Discussion

Sports cards and pop-up type display products are widely used in advertising or as toys. Frequently, they are initially in a folded condition and then unfolded so that a figure of a person or object pops up. The following are patents which depict such conventional products: U.S. Pat. No. Re. 22,109; U.S. Pat. Nos. 2,016,129; 2,148,279; 2,203,578; 2,415,501; 3,090,144; 4,062,138; 4,949,482; 5,010,669. These conventional products do not disclose or suggest the combination of features embodied in the invention disclosed herein.

SUMMARY OF THE INVENTION

The play card of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its advantages, which include a single unit construction, simplicity of use, and low cost, entertainment and collectibility for fans.

The first feature of the play card of this invention is that it has a folded configuration and an unfolded configuration displaying on a base for the card a raised, or pop-up, printed picture of a figure (or figures) of, for example, a celebrity. The play card is made from a unitary piece of sheet material having a generally rectangular shape and a predetermined length, for example from about 10 to about 14 inches, a central longitudinal axis, and leading and trailing edges. The width of the material is typically about 2.5 to about 4 inches. There is preferably depicted on the card a scene of spectators observing the figure in action.

The second feature is that the sheet has a plurality of score lines that are perpendicular to the longitudinal axis and are each respectively positioned inward from the leading and trailing edges. The sheet is folded inward along selected, predetermined ones of these score lines to provide a back section, a central section, and a base section including a front panel, a connector panel, and a top panel. The top panel has a portion of the figure die-cut into the plane of the top panel in outline form.

The third feature is that the central section is folded inward along another selected, predetermined one of the score lines to bring the connector panel into an abutting relationship with a portion of the central section. The connector panel is attached, for example glued, to the portion of the central section to provide a collapsible box-like base structure with a gap between the connector panel and the portion of the central section. The gap is adapted to receive and hold the leading edge of the sheet when the card is in the unfolded configuration. The connector panel may be attached to the nearby portion of the central section by means of an adhesive.

The fourth feature is that the box-like base structure, when the card is in the folded configuration, collapses upon itself into a generally flat condition with the portion of the figure lying in the plane of the top panel. When the card is in the unfolded configuration, the box-like base structure supports the unfolded card in an upright position with the portion of the figure assuming an erect, upright, popped up condition.

The fifth feature is that the back section is folded inward along still another selected, predetermined one of the score lines to enable the leading edge to be inserted into the gap when the card is in the unfolded configuration.

The sixth feature is that there may be side panel on each side the back section which is folded inward when the card is in the folded configuration and unfolded outward to provide sides adjacent the top panel when the card is in the unfolded configuration.

In the preferred embodiment, the sheet has a total of six score lines:

First and second score lines that are each respectively positioned from the leading and trailing edges at a distance equal to about $\frac{1}{3}$ of the length of the sheet. The sheet is folded inward along these first and second score lines to provide the base, central, and back sections. These sections are almost of equal length, but with the back section being slightly longer than the central section and the base section being slightly shorter than the central section.

A third score line in the base section that is positioned from the trailing edge at a distance equal to about $\frac{1}{4}$ of the length of the base section and a fourth score line that is positioned from the first score line a distance equal to about $\frac{1}{4}$ of the length of the base section. The base section is folded inward along the third and fourth score lines to provide the front, connector, and top panels. The front and connector panels are substantially equal in length and the top panel has a length greater than the length of either of said front and connector panels.

A fifth score line in the central section that is positioned from the first score line at a distance substantially equal to the length of the top panel. The central section is folded inward along this fifth score line to bring the trailing edge of the sheet and the fifth score line into an adjacent relationship and the connector panel into an abutting relationship with a portion of the central section that is nearby the fifth score line.

A sixth score line in the back section that is positioned from the second score line at a distance equal to about $\frac{1}{3}$ of the length of the back section. The back section is folded inward along this sixth score line to enable the leading edge to be inserted into the gap when the card is in the unfolded configuration.

DESCRIPTION OF THE DRAWING

The preferred embodiments of this invention, illustrating all its features, will now be discussed in detail. These embodiments depict the novel and non-obvious play card of this invention shown in the accompanying drawing, which is for illustrative purposes only. This drawing includes the following figures (Figs.), with like numerals indicating like parts:

FIG. 4 is a perspective view of the play card being manually unfolded, with the back section being moved outward from the folded position shown in FIG. 1, and cut-away pop up figures lying in the plane of the sheet material from which the figures are die-cut.

FIG. 5 is a perspective view showing the play card in a partially unfolded condition, with the cut-away pop up figures partially standing erect and the leading edge being tucked into the gap between the connector panel and the nearby portion of the central section.

FIG. 6 is a perspective view showing the play card in its fully unfolded condition.

FIG. 7 is a perspective view of an alternate embodiment of this invention illustrating the use of side panels.

FIG. 8 is a perspective view of the alternate embodiment similar to that of FIG. 7 illustrating the side panels being unfolded outward.

DESCRIPTION OF THE PREFERRED EMBODIMENTS

Figures 1, 2, 3A, 3B:
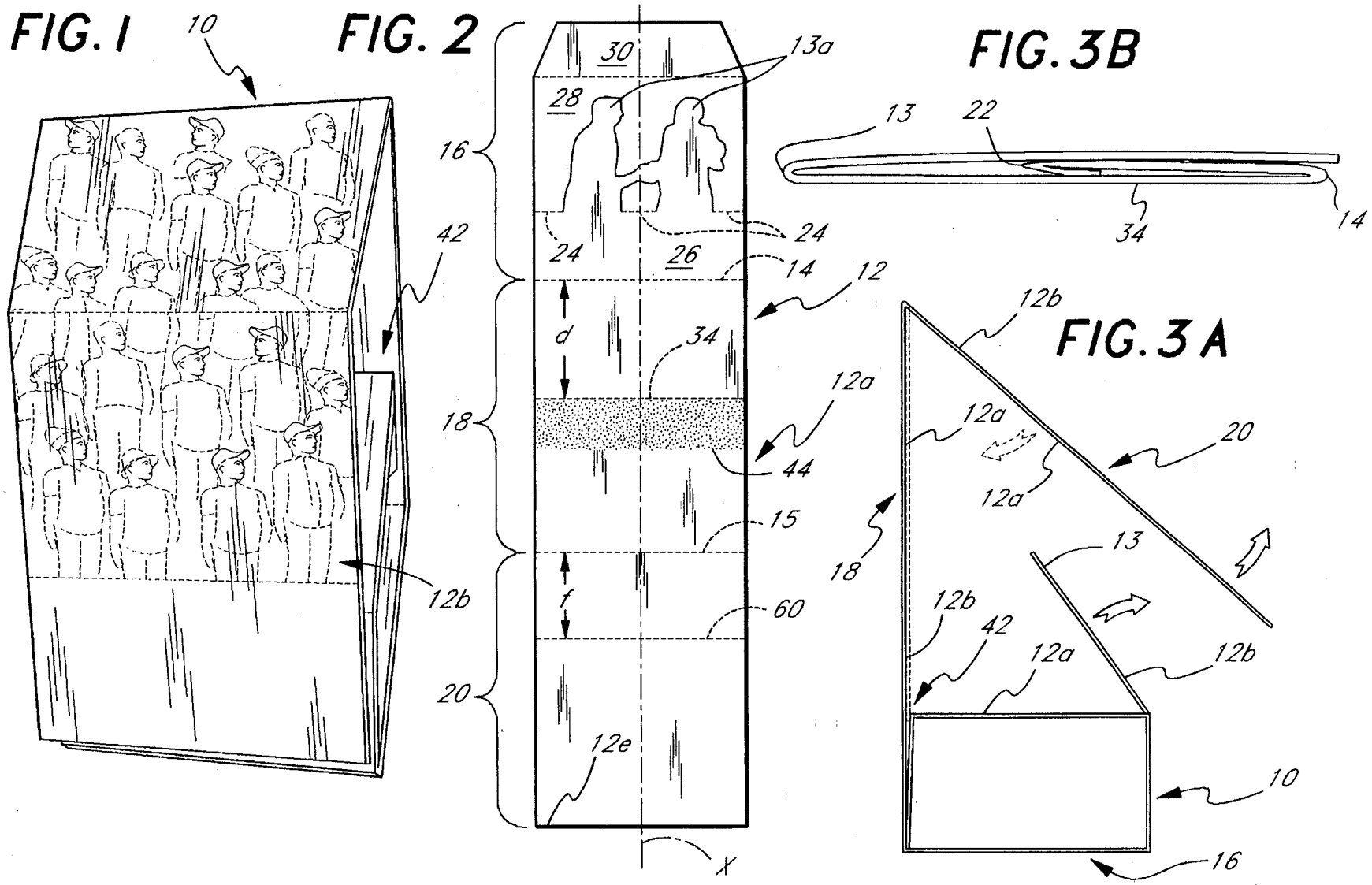
FIG. 1 is a perspective view of the play card of this invention in the folded configuration.
FIG. 2 is a plan view of a single, unitary sheet material from which the play card of this invention is made showing the score line along which the sheet material is folded.
FIG. 3A is a side elevation view showing the play card being unfolded.
FIG. 3B is a side elevation view showing the play card in its folded configuration.

As best illustrated in FIG. 2, the play card 10 is formed from a unitary piece of sheet material 12, such as, for example, cardboard having a leading edge 12*c* and a trailing edge 12*d*. The inside surface 12*a* of the sheet material 12 is shown facing outward in FIG. 2, and scenes and figures of, for example, an athlete or athletes participating in a sport, are printed on the outside surface 12*b* of the sheet material 12, as best illustrated in FIGS. 1, 4 and 5. In this specific example, the FIG. 13 depicts two boxers. The inside, or reverse, surface 12*a* may be printed with information about the athletes 13.

The sheet material 12 may be easily bent along a score line such as a crease, yet is semi-rigid or stiff, enabling the play card 10 to stand upright. Typically, the sheet material 12 has a rectangular configuration, with a length of approximately twelve inches and a width of approximately three inches. The sheet material 12 is folded inward along two main score lines 15 and 14 that are disposed perpendicular to the central, longitudinal axis x of the sheet material 12. This folding defines in the sheet material 12 a base section 16, a central section 18, and a back section 20. The base section 16 is about 3.5 inches long, the central section 18 is about 4.0 inches long, and the back section is about $4\frac{1}{8}$ inches long.

The base section 16 is folded inward along two score lines 22 and 24, which are also perpendicular to the longitudinal axis x of the sheet material 12. This provides in the base section 16 a front panel 26, a top panel 28, and a connector panel 30. The front and connector panels 26 and 30, respectively, are about equal in length and are approximately $\frac{1}{4}$ the length of the base section 16. That is, the front panel 26 and connector panel 30 are each about $\frac{3}{4}$ inch long, and the top panel is about $1\frac{3}{4}$ inch long.

In the central section 18, there is a score line 34 perpendicular to the longitudinal axis x of the sheet material 12. The distance d between the score line 14 and the score line 34 is about $1\frac{3}{4}$ inches. The connector panel 30 is folded inward along the score line 22 and the top panel 28 is folded inward along the score line 24 to bring the outside surface 12*b* of the connector panel into contact with the shaded area 40 below and immediately adjacent or nearby the score line 34, as depicted in FIG. 2. The trailing edge 12*d* is moved adjacent and the score line 34, and the outside surface 12*b* of the connector panel 30 is moved into an abutting relationship with and fastened to the shaded area 40. The means of attachment may be glue, or a reusable adhesive such as a two sided tape well known to graphic art designers. Only a portion of the outside surface 12*b* of the connector panel 30 is adhered to the shaded area 40. As shown in FIGS. 3A and 5, there is a non-adhered segment which forms a gap 42 between the connector panel 30 and a nearby, inside portion of the central section 18, along the edge 44 of the shaded area 40. This gap 42 is adapted to receive and hold the leading edge 12*c* of the sheet material 12 when the play card 10 is in the unfolded configuration.

In the top panel 28, there is a pop-up, cut-a-way section 13*a* made using conventional die cutting techniques. This cut-a-way section 13*a* corresponds to the outline of the printed FIG. 13, except for the lower portion of the figure. Specifically, the cut-a-way section 13*a* corresponds to the upper torsos of the boxers. The score line 24 is intermittent, breaking into open sections, so that there isn't any crease along the lower portion of the FIG. 13. As best shown in FIGS. 3A and 6, this partial cutting of the top panel 28 and intermittent score line 24 enables the pop-up, cut-a-way section 13*a* to stand erect when the play card 10 is in its fully unfolded, upright configuration. In this fully unfolded, upright configuration, the base section 16 unfolds into a box-like structure 50, as best depicted in FIGS. 3A and 6. The cut-a-way section 13*a* now lies in the plane of the front panel 26, extending upright, generally vertical when the play card 10 is placed on a flat horizontal surface.

As shown in FIGS. 1 and 3B, in the folded configuration, the cut-a-way section 13*a*, the top panel 28, and the front panel 26 all lie in the same common plane, and the back section 20 is folded inward about the score line 15, covering the cut-a-way section 13*a* , the top panel 28, and the front panel 26. The box-like structure 50 is now collapsed, and the play card 10 now resembles a closed book of matches. The adhered surfaces of the base section 16 and central section 18, and the carefully preselected positioning of the score lines 34, 22, 24, and 14, cause the box-like structure 50 to folded and unfold as a parallelogram.

To facilitate the positioning of the leading edge 12*c* in the gap, there is a sixth score line 60 generally perpendicular to the longitudinal axis x of the sheet material 12. This score line 60 is about $\frac{1}{3}$ the length of the back section 20 from the score line 15. The distance y between the score line 60 and the score line 15 is about $1\frac{1}{4}$ inches.

The play card 10 of this invention is easy to manufacture. All that is required is that six score lines 22, 24, 14, 34, 15, and 60 be made in the stiff but foldable, single, unitary sheet material 12 by creasing along these lines. The base section 16 is then folded inward about the score lines 14, 24, and 22, and the connector panel 30 is glued or otherwise attached to the shaded area 40 adjacent to the score line 34 to provide the collapsible box-like base structure 50. The back section 20 is folded over the one score line 15 to cover this collapsed base structure 50. Upon unfolding, the play card 10 as depicted in FIGS. 4 and 5, the back section 20 is unfolded about the score line 15 and the base structure 50 is manually manipulated so that the cut-a-way section 13*a* pops up as depicted in FIG. 5. Then the back section 20 is folded about the score line 60, tucking the leading edge 12*c* into the gap 42. This provides the upright, unfolded configuration depicted in FIG. 6.

In the alternate embodiment of this invention, play card 10*a*, there is a pair of side panels 70 and 72, one on each side of the back section 20. Each side panel 70 and 72 is folded inward along score lines (not shown) that extend along the outside edges of the back section 20, so that the play card 10a may assume a generally flat folded configuration. Upon unfolding, these side panels 70 and 72 are moved outward and positioned adjacent the top panel 28, as shown in FIG. 8. These side panels 70 and 72 will match and continue the graphic display of the outside surface 12*b*. Preferably, there are tabs 80 that are inserted into die-cut slots 82 in the top panel 28.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

I claim:

1. A play card which has a folded configuration and an unfolded configuration displaying a raised figure on a base for the card, said play card comprising a generally rectangular sheet having a predetermined length, a central longitudinal axis, and leading and trailing edges, said sheet having first and second score lines that are perpendicular to the longitudinal axis and are each respectively positioned from said leading and trailing edges at a distance about equal to $\frac{1}{3}$ of the length of the sheet, said sheet being folded inward along said first and second score lines to provide a base section, a central section, and a back section, said sections being almost of equal length, but with the back section being slightly longer than the central section and the base section being slightly shorter than the central section, said base section having a third score line that is perpendicular to the longitudinal axis and positioned from said trailing edge at a distance about equal to $\frac{1}{4}$ of the length of the base section and a fourth score line that is positioned from said first score line a distance about equal to $\frac{1}{4}$ of the length of the base section, said base section being folded inward along said third and fourth score lines to provide a front panel, a connector panel, and a top panel having a portion of said figure cut into a plane of the top panel in outline form, said front and connector panels being substantially equal in length and said top panel having a length greater than the length of either of said front and connector panels, said central section having a fifth score line that is perpendicular to the longitudinal axis and positioned from said first score line at a distance substantially equal to the length of the top panel, said central section being folded inward along said fifth score line to bring the trailing edge of the sheet and the fifth score line into an adjacent relationship and the connector panel into an abutting relationship with a portion of the central section that is nearby said fifth score line, said connector panel being attached to said nearby portion of the central section to provide a collapsible box-like base structure with a gap between the connector panel and said nearby portion which is adapted to receive and hold the leading edge of the sheet when the card is in the unfolded configuration, said box-like base structure, when the card is in the folded configuration, collapsing upon itself into a generally flat condition with said portion of the figure lying in the plane of the top panel, and, when the card is in the unfolded configuration, said box-like base structure supporting the unfolded card in an upright position with said portion of the figure assuming an erect upright condition, said back section having a sixth score line that is perpendicular to the longitudinal axis and positioned from said second score line at a distance about equal to $\frac{1}{3}$ of the length of the back section, said back section being folded inward along said sixth score line to enable the leading edge to be inserted into said gap when the card is in the unfolded configuration.

2. The play card of claim 1 where the sheet is a single, unitary piece of material.

3. The play card of claim 2 where the sheet has a length of 10 to 14 inches and a width of 2.5 to 4 inches.

4. The play card of claim 1 where there is side panel on each side the back section which are folded inward when the card is in the folded configuration and unfolded outward to provide sides adjacent the top panel when the card is in the unfolded configuration.

5. The play card of claim 4 where there are graphics on the back section and side panels depicting a schene which continues from the back section to the side panels.

6. The play card of claim 1 where there are a plurality of figures cut into the top panel.

7. The play card of claim 1 where there are depicted on the card scenes of spectators observing the figure in action.

8. The play card of claim 1 where the connector panel is attached to the nearby portion of the central section by means of a reusable adhesive.

9. A play card which has a folded configuration and an unfolded configuration displaying a raised figure on a base for the card, said play card comprising a generally rectangular, unitary piece of sheet material having a predetermined length, a central longitudinal axis, and leading and trailing edges, said sheet material having a first and second score lines that are perpendicular to the longitudinal axis and are each respectively positioned inward from said leading and trailing edges, said sheet being folded inward along each of said first and second score lines to provide a base section, a central section, and a back section, said base section having a third score line that is perpendicular to the longitudinal axis and positioned from said trailing edge at a first predetermined distance substantially shorter than the length of the base section and a fourth score line that is positioned from said first score line a distance about equal to said first predetermined distance, said base section being folded inward along said third and fourth score lines to provide a front panel, a connector panel, and a top panel having a portion of said figure cut into a plane of the top panel in outline form, said front and connector panels being substantially equal in length and said top panel having a length greater than the length of either of said front and connector panels, said central section having a fifth score line that is perpendicular to the longitudinal axis and positioned from said first score line at a distance substantially equal to the length of the top panel, said central section being folded inward along said fifth score line to bring the trailing edge of the sheet and the fifth score line into an adjacent relationship and the connector panel into an abutting relationship with a portion of the central section that is nearby said fifth score line, said connector panel being attached to said nearby portion of the central section to provide a collapsible box-like base structure with a gap between the connector panel and said nearby portion which is adapted to receive and hold the leading edge of the sheet when the card is in the unfolded configuration, said box-like base structure, when the card is in the folded configuration, collapsing upon itself into a generally flat condition with said portion of the figure lying in the plane of the top panel, and, when the card is in the unfolded configuration, said box-like base structure supporting the unfolded card in an upright position with said portion of the figure assuming an erect upright condition, said back section having a sixth score line that is perpendicular to the longitudinal axis and positioned from said second score line at a second predetermined distance, said back section being folded inward along said sixth score line to enable the leading edge to be inserted into said gap when the card is in the unfolded configuration.

10. The play card of claim 9 where said sections are almost of equal length, but with the back section being slightly longer than the central section and the base section being slightly shorter than the central section.

11. The play card of claim 10 where the sheet has a length of 10 to 14 inches and a width of 2.5 to 4 inches.

12. The play card of claim 11 where the connector panel is attached to the nearby portion of the central section by means of a reusable adhesive.

13. The play card of claim 9 where there are a plurality of figures cut into the top panel.

14. The play card of claim 9 where there is side panel on each side of the back section which are folded inward when the card is in the folded configuration and unfolded outward to provide sides adjacent the top panel when the card is in the unfolded configuration.

15. The play card of claim 14 where there are depicted on the back section and side panels scenes of spectators observing the figure in action.

16. A play card which has a folded configuration and an unfolded configuration displaying a raised figure on a base for the card, said play card comprising a generally rectangular sheet having a predetermined length, a central longitudinal axis, and leading and trailing edges, said sheet having a plurality of score lines that are perpendicular to the longitudinal axis and are each respectively positioned inward from said leading and trailing edges, said sheet being folded inward along predetermined ones of said score lines to provide a base section, a central section, a back section including a front panel, a connector panel, and a top panel having a portion of said figure cut into a plane of the top panel in outline form, said central section being folded inward along another predetermined one of said score lines to bring the connector panel into an abutting relationship with a portion of the central section, said connector panel being attached to said portion of the central section to provide a collapsible box-like base structure with a gap between the connector panel and said portion which is adapted to receive and hold the leading edge of the sheet when the card is in the unfolded configuration, said box-like base structure, when the card is in the folded configuration, collapsing upon itself into a generally flat condition with said portion of the figure lying in the plane of the top panel, and, when the card is in the unfolded configuration, said box-like base structure supporting the unfolded card in an upright position with said portion of the figure assuming an erect upright condition, said back section being folded inward along still another predetermined one of said score lines to enable the leading edge to be inserted into said gap when the card is in the unfolded configuration.

17. The play card of claim 16 where said front and connector panels are substantially equal in length and said top panel has a length greater than the length of either of said front and connector panels.

18. The play card of claim 17 where said sections are almost of equal length, but with the back section being slightly longer than the central section and the base section being slightly shorter than the central section.

19. The play card of claim 17 where the sheet is a single, unitary piece of material.

20. The play card of claim 19 where there is side panel on each side the back section which are folded inward when the card is in the folded configuration and unfolded outward to provide sides adjacent the top panel when the card is in the unfolded configuration.

* * * * *